US005941581A

United States Patent [19]

Heithe

[11] Patent Number: 5,941,581

[45] Date of Patent: Aug. 24, 1999

[54] DOOR LOCK ARRANGEMENT

[75] Inventor: Michael E. Heithe, Duarte, Calif.

[73] Assignee: NT Falcon Lock, Brea, Calif.

[21] Appl. No.: 08/939,150

[22] Filed: Sep. 29, 1997

[51] Int. Cl.[6] ..... E05B 63/20

[52] U.S. Cl. ..... 292/332; 292/335

[58] Field of Search ..... 292/165, 170, 292/181, 332, 335, 336.3; 70/107, 131, 142, 152, 467, 470, 474, 481

[56] References Cited

U.S. PATENT DOCUMENTS

| | | | |
|---|---|---|---|
| 917,399 | 4/1909 | Augenbraun . | |
| 2,086,982 | 7/1937 | McCarter . | |
| 2,564,161 | 8/1951 | Koreska . | |
| 3,621,686 | 11/1971 | Klein . | |
| 4,262,504 | 4/1981 | Inoue | 70/151 |
| 4,389,061 | 6/1983 | Foshee | 292/169.14 |
| 4,765,663 | 8/1988 | Raymond | 292/169.13 |

*Primary Examiner*—Steven Meyers
*Assistant Examiner*—Gary Estremsky
*Attorney, Agent, or Firm*—Don Finkelstein

[57] ABSTRACT

A door lock arrangement comprising a frame, a door handle, a slidable deadbolt arrangement, a depressable trigger member for releasing the slidable deadbolt, a deadbolt driver for sliding the deadbolt to its extended position when triggered, and a bidirectional retraction assembly, whereby rotation of the door handle in either direction moves the deadbolt from the extended position to the retracted position. In another aspect of the invention, there is provided a door lock arrangement comprising a frame, a door handle, a slidable deadbolt arrangement, a depressable trigger member for releasing the slidable deadbolt, a deadbolt driver for sliding the deadbolt to its extended position when triggered, and a retraction assembly comprising a retraction arm having a nose portion which interferes with a part of the deadbolt when the deadbolt attempts to return to its retracted position, thereby reliably and securely blocking retraction of the deadbolt and frustrating any tampering attempt to move the deadbolt back into the fixture with a tool pressing against the distal end of the deadbolt. The door handle releases the blocking effect of the retraction arm and, simultaneously, draws the deadbolt rearwardly into its retracted position.

15 Claims, 6 Drawing Sheets

DOOR LOCK ARRANGEMENT

BACKGROUND OF THE INVENTION

1. Field of the Invention

This invention relates to the field of door lock arrangements, and in particular to a deadbolt which automatically extends into the door casing when the door is closed.

2. Brief Description of the Prior Art

Automatic deadbolt arrangements are known in the art. For example, U.S. Pat. No. 4,765,663 to Raymond et al. discloses a spring-loaded deadbolt which is automatically extended when the door into which the assembly is fitted is closed. The Raymond et al. lock assembly contains a spring-loaded deadbolt and spring-loaded plunger intercoupled to one another. The assembly is arranged such that, when the door is closed, the plunger is pushed in by the striker plate on the door frame, and this releases the spring-biased deadbolt and causes the deadbolt to be fully extended into the cavity in the striker plate. When that occurs, the linkage coupling the assembly to the door knob moves to a position in which one of its members serves as a stop to prevent the deadbolt from being forced back to a retracted position until the door knob is turned.

Another deadbolt locking device is disclosed in U.S. Pat. No. 4,262,504 to Inoue. This prior art reference discloses a locking device for locking a door and is suitable for use in an electric locking system. The device has a deadbolt which is held in a retracted position within a housing, and an actuating member adapted to be partially projected out of the housing, when the door is open. The actuating member is interrelated with the deadbolt such that the latter is driven into a hole in the door jam as the slidable member is depressed by the door in the course of closing the door. An electromagnetic plunger is provided for allowing the retraction of the deadbolt, and a manually operative member is associated with the electromagnetic plunger to allow a manual unlocking if necessary.

Other patents relating to the field of automatic locking devices are known, but are less pertinent than those described above. Among such additional prior art patents are: U.S. Pat. Nos. 600,584 to J. Kaye; U.S. Pat. No. 970,628 to A. Leistler; U.S. Pat. No. 2,854,270 to W. Ward; U.S. Pat. No. 3,891,255 to Millett; British Patent Specification No. 376,968 by Sleigh et al.; Australian Patent Specification No. 135,726 by Zeehuisen; German Patentschrift No. 75175; and German Patentschrift No. 541556.

While the aforementioned prior art teachings address the need for deadbolt lock security and disclose ways in which the deadbolt may be automatically extended when the door into which it is installed is closed, such prior art devices are limited in function and supply only those basic needs. In most prior art deadbolt door lock arrangements, the door knob, or handle, or lever of the trim (hereinafter "handle" for simplicity) will release the deadbolt and retract it, or allow it to be retracted, by turning the handle in one direction only. There is a need for a deadbolt door lock arrangement in which the deadbolt may be retracted by rotating the lever in either of the two rotational directions. This is important for being able to mount the trim to either side of a door, and would be especially important if a handle lever is used instead of a door knob, i.e., the handle must be able to be rotated in either direction for retraction of the deadbolt independent of whether it is mounted on the left side or right side of a door.

Most prior art automatic deadbolt lock arrangements have only two positions for the deadbolt, i.e. fully retracted or fully extended. In the event of an inadvertent triggering to release the deadbolt when the door is open, one must rotate the handle to effect the deadbolt retraction. It would be convenient for a deadbolt lock arrangement to have the ability for resetting the deadbolt, when inadvertently released, by pushing the deadbolt back into the fixture, applying pressure, as with the thumb, against the deadbolt itself.

There is also a need in the art for a more reliable device for ensuring the deadbolt may not be caused to retract by tampering when the door is closed.

SUMMARY OF THE INVENTION

The present invention overcomes all of the deficiencies of the prior art noted above and achieves the objectives for improvements as described.

In accordance with the invention, there is provided a door lock arrangement comprising a frame, a door handle, a slidable deadbolt arrangement, a depressable trigger member for releasing the slidable deadbolt, a deadbolt driver for sliding the deadbolt to its extended position when triggered, and a bidirectional retraction assembly, whereby rotation of the door handle in either direction moves the deadbolt from the extended position to the retracted position.

In another aspect of the invention, there is provided a door lock arrangement comprising a frame, a door handle, a slidable deadbolt arrangement, a depressable trigger member for releasing the slidable deadbolt, a deadbolt driver for sliding the deadbolt to its extended position when triggered, and a retraction assembly comprising a retraction arm having a nose portion which interferes with a part of the deadbolt when the deadbolt attempts to return to its retracted position, thereby reliably and securely blocking retraction of the deadbolt and frustrating any tampering attempt to move the deadbolt back into the fixture with a tool pressing against the distal end of the deadbolt. In this embodiment of the invention, rotation of the door handle releases the blocking effect of the retraction arm and, simultaneously, draws the deadbolt rearwardly into its retracted position.

BRIEF DESCRIPTION OF THE DRAWING

These and other aspects of the invention will be better understood, and additional features of the invention will be described hereinafter having reference to the accompanying drawings in which.

DETAILED DESCRIPTION OF THE PREFERRED EMBODIMENTS

Figure 1:
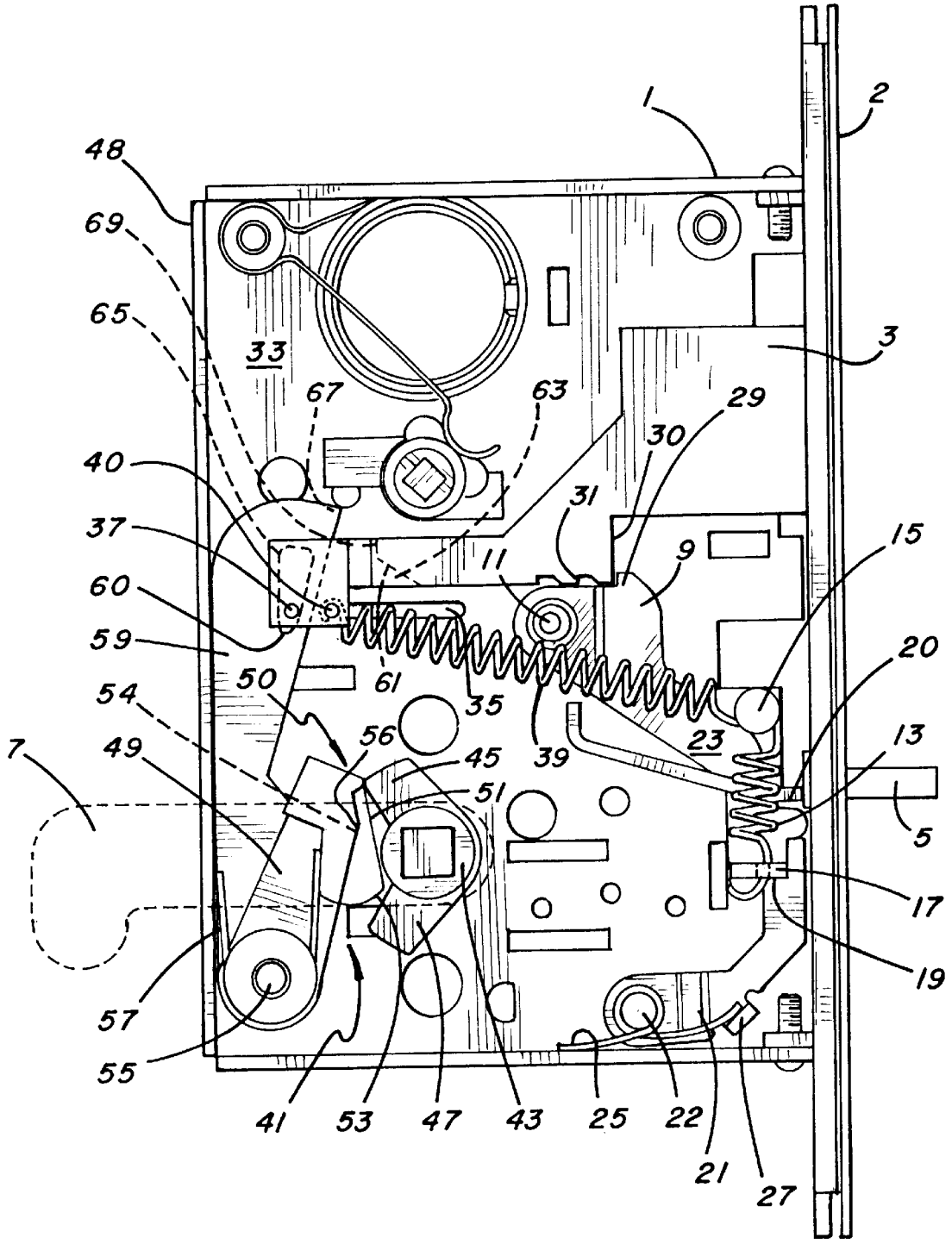
FIG. 1 is a view of the internal construction of the door lock arrangement manufactured in accordance with the present invention, with one casing side removed, and the deadbolt in the retracted position.
Figure 2:
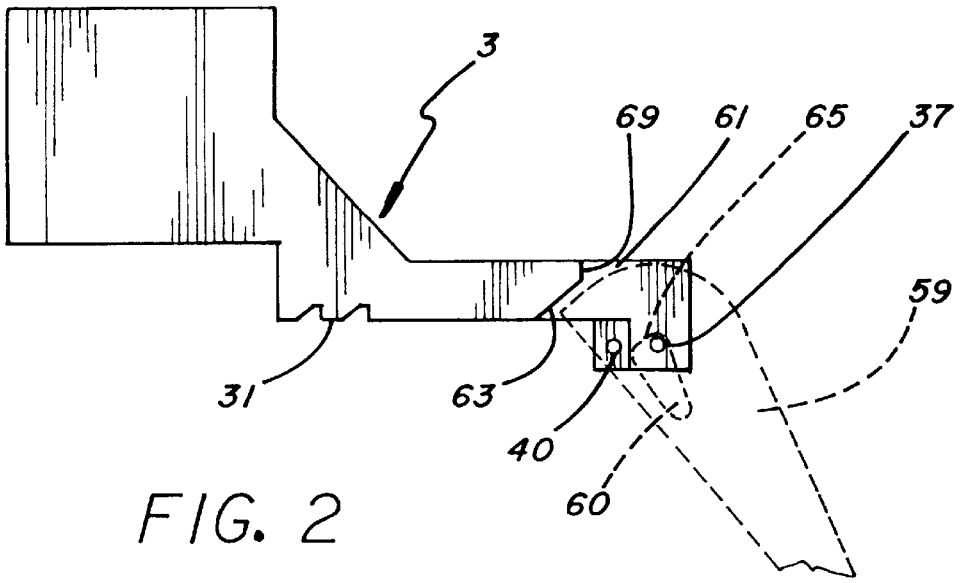
FIG. 2 is a side view of the deadbolt member as viewed from the opposite side as that shown in FIG. 1.
Figure 3:
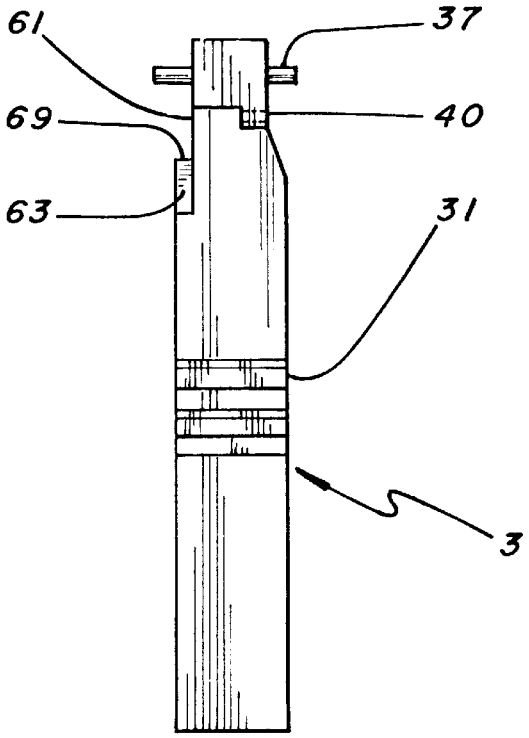
FIG. 3 is a bottom plan view of the deadbolt member shown in FIG. 1.

With reference to FIGS. 1–3, a casing 1 is provided with a faceplate 2 which houses a slidable deadbolt 3 shown in its retracted position in FIG. 1. As will be described later, release of deadbolt 3 to its extended position is effected by depression of, or lateral force applied to, trigger 5. As will also be detailed later, a door handle 7 is rotatably mounted in casing 1 to effect retraction of deadbolt 3.

To retain deadbolt 3 in its retracted position, a holdback lever 9 is provided, lever 9 being pivotally mounted to casing 1 at pivot point 11 and biased into a latch position by holdback tension spring 13 the ends of which are hooked about casing post 15 and a hole 17 in the bent end 19 of an extension arm 23 of holdback lever 9. Bent end 19 extends perpendicular from a flat planar surface of the holdback lever 9.

A trigger bias lever 21 is pivotally mounted over a frame pivot post 22, and has a bent trigger lever leg 20 lying adjacent extension arm 23 when trigger 5 is fully projected out from the faceplate 2. Trigger bias lever 21 is biased away from extension arm 23 and contacts the rear of trigger 5 by the effect of a torsion spring 25 on casing pivot post 22, torsion spring 25 having one end pressing against casing 1 and the other end pressing against a bent tab spring support 27 integral with the trigger bias lever 21. Accordingly, torsion spring 25 is effective to bias trigger 5 to its projected position shown in FIG. 1.

In the retracted position of the deadbolt 3 in FIG. 1, dog 29 of holdback lever 9 engages the shoulder 30 of deadbolt 3, or, as will be explained hereinafter, dog 29 may alternatively engage in any one of the lateral serrations 31 if the trigger 5 is inadvertently bumped while the door is open.

To maintain deadbolt 3 in a linear sliding motion within casing 1, casing sidewall 33 is provided with an elongated slot 35. A pin 37 is fixed within the proximal end of deadbolt 3 and extends on both sides of deadbolt 3 to enter into and have a sliding relationship with slot 35. It will be understood that a second casing sidewall (not shown) similar to casing sidewall 33 closes the casing 1 in the completed construction of the door lock arrangement. Similarly, wherever desired or required for stability, strength, and reliable operation, any element described herein that is pivoted in relation to casing sidewall 33 may also be pivoted in both casing sidewalls. This mechanical expedient is well known in the art and need not be further detailed herein. Only one pivot relationship with the casing 1 is shown for clarity in the drawing.

When trigger 5 is moved in such a manner to apply a force from the right (in FIG. 1) against trigger bias lever 21, and against the bias of torsion spring 25, bent trigger lever leg 20 pushes against extension arm 23 causing holdback lever 9 to rotate clockwise about holdback lever pivot point 11. With nothing further restricting deadbolt 3 from moving out of casing 1, an extension spring 39, coupled between casing post 15 and spring hole 40 at the distal end of deadbolt 3, being a tension spring, draws deadbolt 3 forwardly to extend into the striker plate and deadbolt cavity in the door jam (not shown) and creates the desired deadbolted condition.

Figure 4:
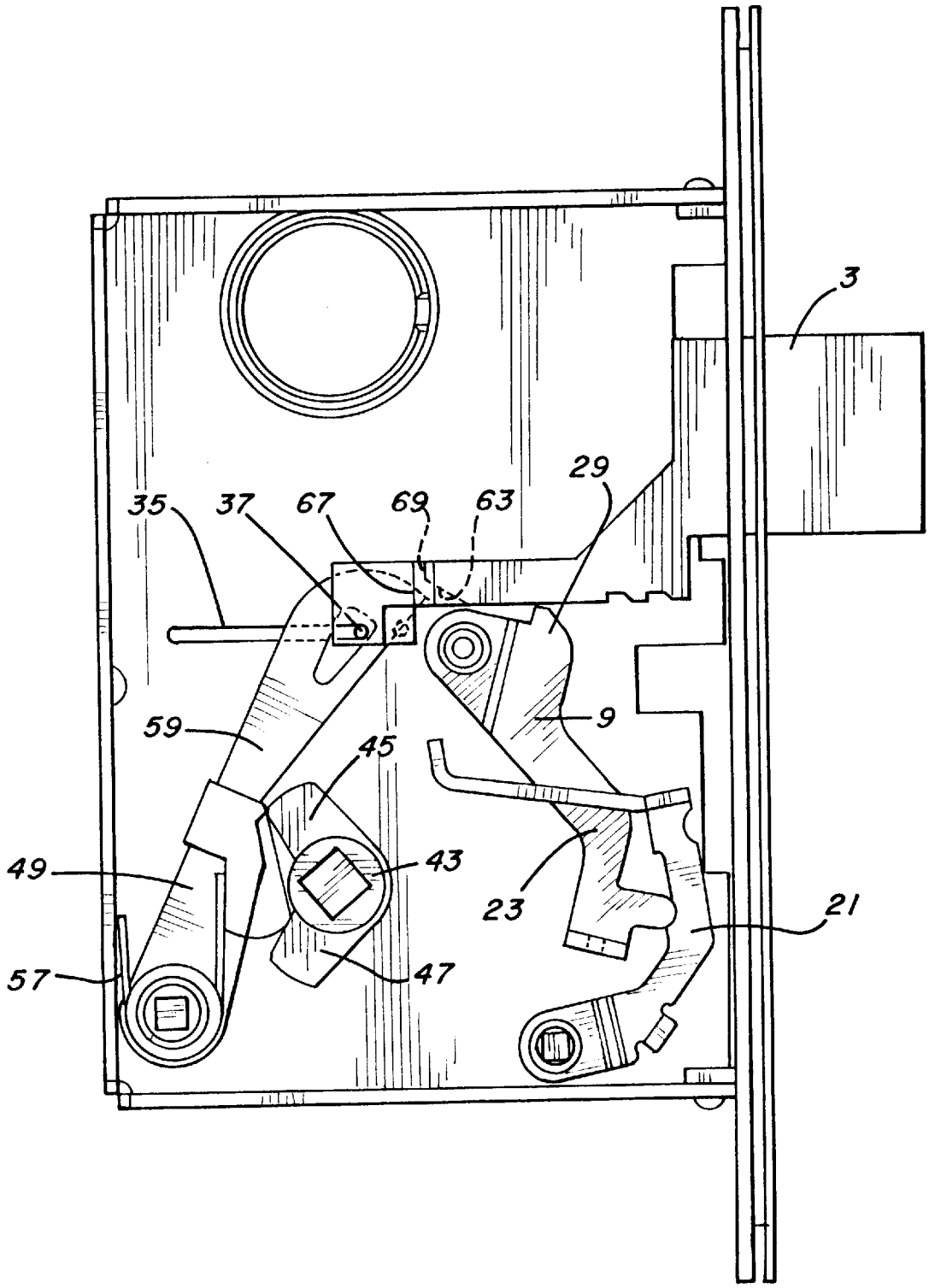
FIG. 4 is a side view similar to that of FIG. 1, but with the deadbolt in a fully extended position.

Typically, upon the pushing in of trigger 5 by closing the door, holdback lever 9 pivots sufficiently to permit deadbolt 3 to attain a full extended position as shown in FIG. 4. In this position, it is important that the deadbolt 3 be secured in the extended position so that any tampering attempts to move deadbolt 3 rearwardly will fail.

Toward this end, a retraction assembly 41 (FIG. 1) is provided, one of the functions of which is to block the rearward movement of deadbolt 3 in the fully extended position. First, it will be explained how the deadbolt 3 is normally retracted by rotation of the handle 7.

Rotation of handle 7 causes hub 43 to rotate within casing 1. Hub 43 has a pair of angularly disposed radial lobes 45 and 47.

A biased coupling 49 is provided with a pair of cam surfaces 51 and 53 which cooperate with the lobes 45 and 47 of hub 43 as will be explained in detail hereinafter.

Biased coupling 49 is pivoted to casing 1 at pivot post 55, and a torsion spring 57, also supported on casing post 55, has one of its arms biased against rear wall 48 of casing 1, and the other arm of spring 57 biases head 50 of the biased coupling 49 toward the apex of the angle between lobes 45 and 47 of hub 43.

As can be appreciated by observing the positional relationship between lobes 45, 47 and cam surfaces 50, 53, when handle 7 is rotated clockwise, the rear facing flat surface of lobe 47 cams the curved cam surface 53 of head 50 and moves head 50 against the force of torsion spring 57 to pivot about post 55 toward the rear of the casing 1.

As biased coupling 49 pivots rearwardly, an arm engaging surface 54, which may be of identical configuration as that of head extension 56, but on the opposite side of coupling 41 (not shown) engages the edge of retraction arm 59, and pivots retraction arm 59 rearwardly about casing post 55 upon continued camming of surface 53 by lobe 47 as handle 7 is rotated clockwise. This rearward pivoting movement of retraction arm 59 effects relative movement of pin 37 to the right in FIG. 1 across the width 65 of opening 60 to be engaged by the right side of opening 60, after which point deadbolt 3 is pulled further rearwardly as retraction arm 59 pivots further rearwardly. Eventually, dog 29 will pass over and be biased in a counterclockwise position spring 13 to engage shoulder 30, and the door lock arrangement is returned to the retracted condition.

As will be best seen by reference to FIG. 4, when deadbolt 3 is released and slid to its fully extended position, pin 37, bearing against the left side of opening 60 in retraction arm 39, is pulled along with deadbolt 3. When deadbolt 3 reaches full extension, i.e. when pin 37 is at the right end of slot 35 in casing 1, retraction arm 59 continues to move forwardly due to its momentum during the quick extension movement, assisted by gravity. That is, the center of gravity of retraction arm 59 is obviously to the right of pivot post 55, and thus the free end of retraction arm 59 falls to the right (in FIG. 1) with pin 37 now against the left side of opening 60. In this position of retraction arm 59, it will be noted that the nose 67 of retraction arm 59 is moved into a position directly in the linear rearward path of a sloped ledge 63 adjacent the proximal end of deadbolt 3, ledge 63 being formed by providing a cutaway portion 61 as best viewed in FIG. 2.

Since sloped ledge 63 tends to push retraction arm 59 axially toward casing post 55, and since ledge 63 is confined to a horizontal linear path due to pin 37 being confined to the narrow horizontal slot 35 in casing sidewall 33, any attempt to move deadbolt 3 rearwardly will fail, as the deadbolt and retraction arm 59 are in a wedged condition. However, as previously described, when handle 7 is rotated, biased coupling 49 moves retraction arm 59 to pivot rearwardly, engaging pin 37, and drawing deadbolt 3 rearwardly to its retracted position.

To this point, the retraction of deadbolt 3 has been described as a result of rotating handle 7 clockwise. An identical functional result occurs when handle 7 is rotated counterclockwise. In this event, the rearward rounded corner of lobe 45 cams the flat cam surface 51 of biased coupling head 50, which camming action rotates biased coupling 49 counterclockwise about post 55, and the identical analysis for retracting deadbolt 3 may be applied. Thus, handle 7 may be rotated in either direction to effect identical functional operation of the door lock arrangement according to the present invention.

In this connection, it will be noted that torsion spring 57 moves coupling head 50 so as to cause simultaneous engagement between lobe 45 with cam surface 51 and lobe 47 with cam surface 53. This creates a balanced position for hub 43 and door handle 7. That is, this arrangement ensures that handle 7 will always return to the identical stable position after it is rotated clockwise, or counterclockwise, and then released.

It will be appreciated that, when the door is open, deadbolt 3 is fully retracted, and trigger 5 is extended out of faceplate 2 of the casing 1. It is often the case that a piece of clothing, or body or object movement close to the edge of an open door will slightly nudge trigger 5 and release deadbolt 3 to an extended position. If the nudge is slight and/or quick, the present invention is structured to prevent the deadbolt 3 to attain full extension. of course, if the door is closed, i.e. trigger 5 is pushed in for a long period of time, full extension of deadbolt 3 will always be effected.

In the event, however of a slight or quick triggering of deadbolt 3, dog 29 may engage the first or second (or more, not shown) serration 31 on deadbolt 3. If dog 29 engages in the forwardmost serration 31, deadbolt 3 is permitted to extend only slightly forward of faceplate 2. In this position, one may simply close the door, and the curved striker plate on the door jam will cam the deadbolt 3 inwardly until dog 29 latches with shoulder 30.

Figure 5:
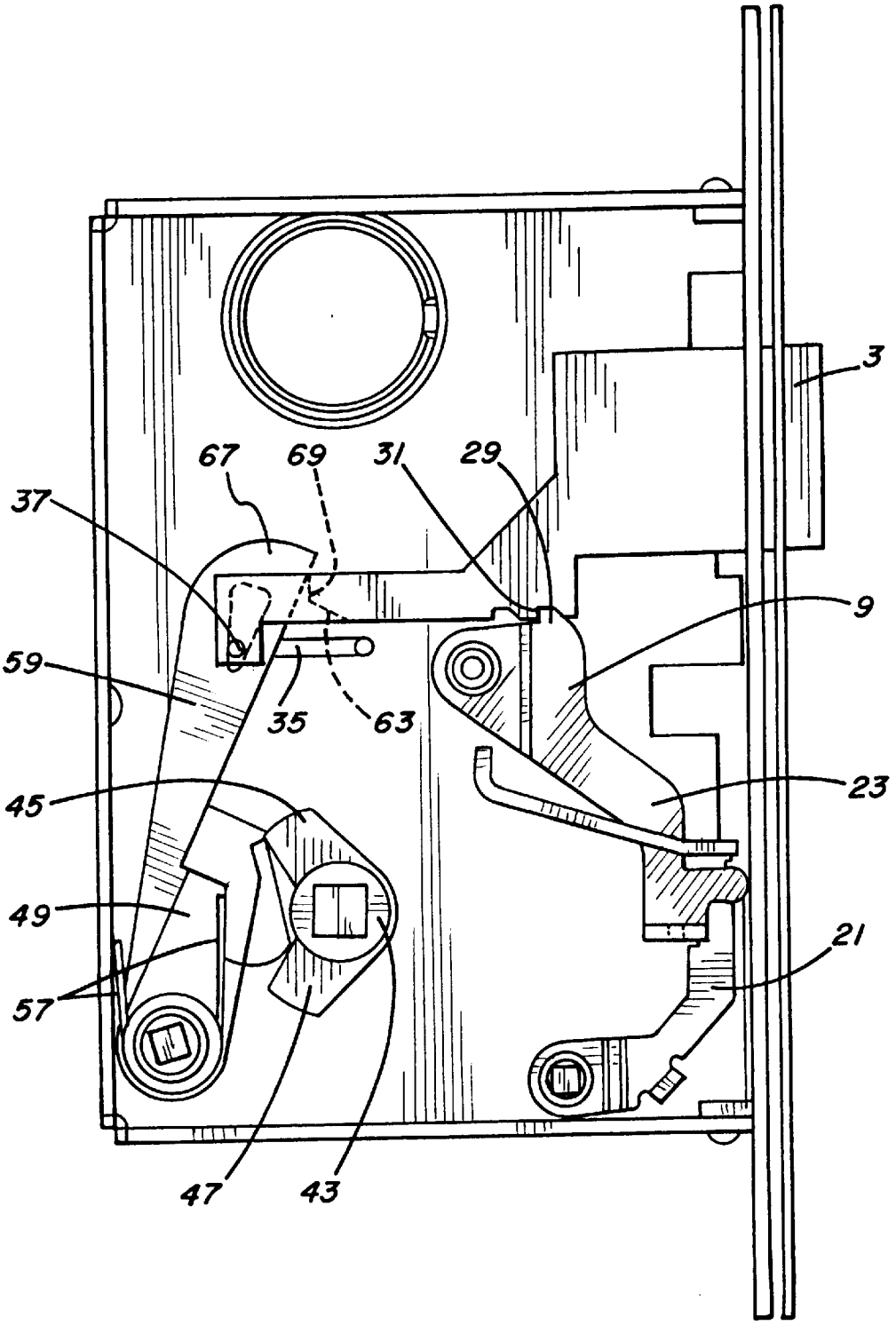
FIG. 5 is a side view similar to that of FIG. 1, but with the deadbolt in a partially extended position.

However, in the event that trigger 5 is depressed for a longer period of time, dog 29 may engage the rearwardmost serration 31 on deadbolt 3. In this event, deadbolt 3 will be extended too far out of faceplate 2 for the striker plate to push it back in. By observing the mechanical relationship of the internal workings of the door lock arrangement when in this partial extended position shown in FIG. 5, the nose 67 of retraction arm 59 has not been permitted to yet come into the path of ledge 63 on deadbolt 3. Accordingly, one may simply push deadbolt 3 back into casing 1 with their thumb, and the blunt vertical wall 69 will simply push retraction arm 59 rearwardly as deadbolt 3 continues to move rearwardly and dog 29 latches with shoulder 30. That is, in all positions of deadbolt 3 except the fully extended position, nose 67 of retraction arm 59 will not be in the linear path of ledge 63. The wedged condition thus exists only when the deadbolt is at the fully extended position at which, of course, securement against tampering is to be in effect.

Referring to FIGS. 1, 4, 5, and 7, a stop post 24 is fixed on casing sidewall 33 in a position to limit the swing of holdback lever 9, which, in turn, limits the swing of trigger bias lever 21 when trigger 5 is pressed into the casing 1. This avoids accidental jamming of trigger 5 against the inner side of faceplate 2, and prevents vandals from pushing trigger 5 into faceplate 2 to purposely jam the lock. The bent trigger lever leg 20 does not contact post 24 in any normal operating position.

Figure 6:
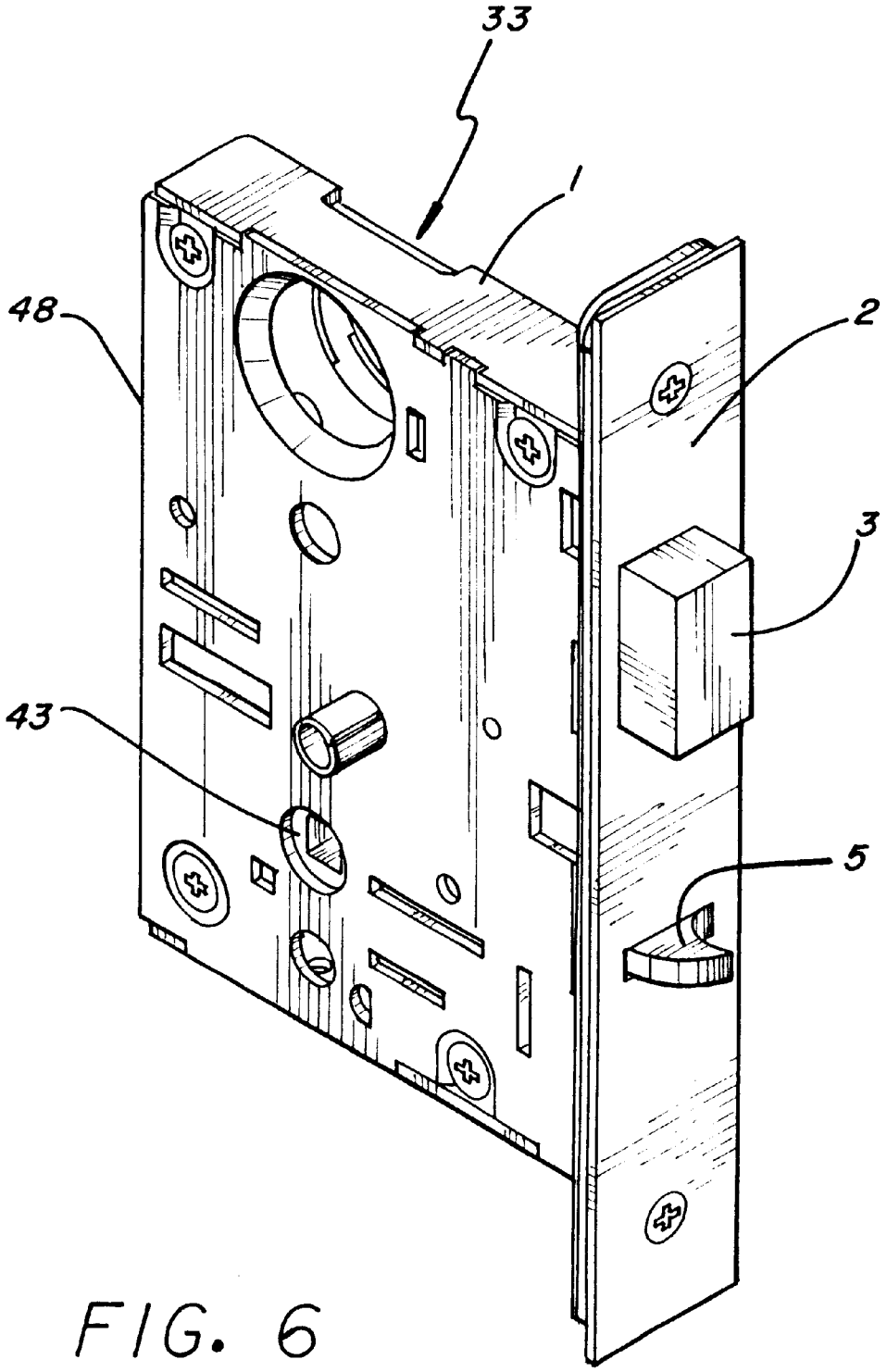
FIG. 6 is a perspective view of the assembled door lock arrangement.
Figure 7:
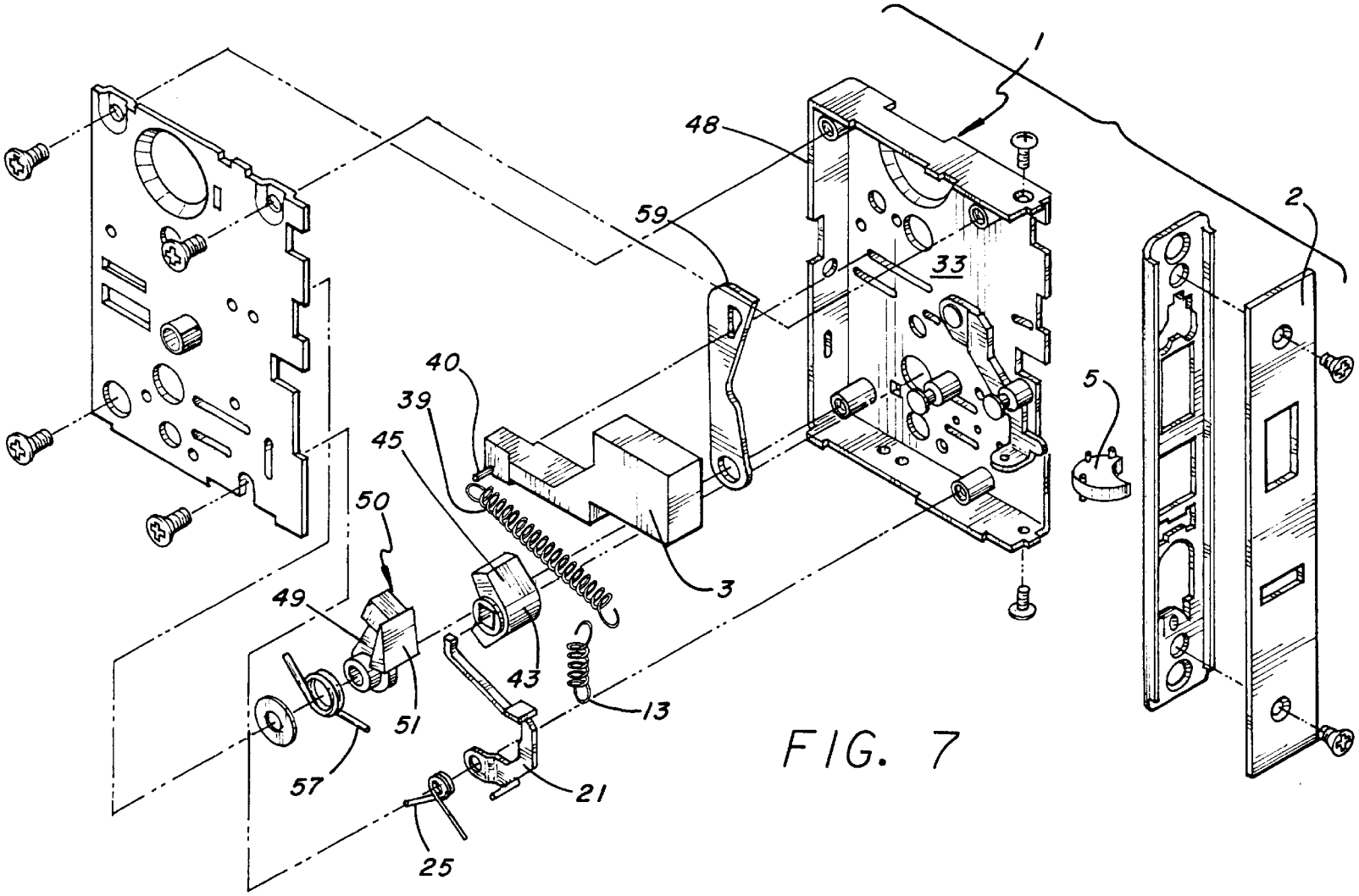
FIG. 7 is a perspective exploded view of the component parts of the door lock arrangement.

FIG. 6 is a perspective view of the assembled door lock arrangement, and FIG. 7 is a perspective exploded view of the component parts of the door lock arrangement. These views show the positional relationships and the shapes of the component parts of the door lock arrangement.

It will therefore be appreciated that the present invention as described herein fulfills the objectives set forth: the provision of an automatic deadbolt lock in which the deadbolt may be retracted by rotation of the handle in either direction; an effective, secure, and reliable guard against tampering when the deadbolt is in the fully extended position; and a convenient procedure for returning a deadbolt to its retracted position when inadvertently triggered when the door is open.

While only certain embodiments of the invention have been set forth above, alternative embodiments and various modifications will be apparent from the above description and the accompanying drawing to those skilled in the art. For example, the extension spring 39 for driving the deadbolt 3 to its fully extended position may be replaced by a compression spring, an electric solenoid, or any other actuator which is effective to slide a deadbolt linearly upon release of the deadbolt latch. These and other alternatives are considered equivalents and within the spirit and scope of the present invention.

What is claimed is:

1. A door lock arrangement comprising:

a frame having an elongated slot in a side thereof;

a door handle;

a deadbolt slidable in sliding directions in said frame between a retracted position and an extended position;

a holdback lever latchable with said deadbolt and movably mounted on said frame for movement between a latch position at which said deadbolt is prevented from moving to said extended position from said retracted position, and an unlatch position at which said deadbolt is free to move to said extended position from said retracted position, and said holdback lever is resiliently biased toward said latch position;

a depressable trigger member projecting through a side of said frame, said trigger member, when depressed, engaging said holdback lever and moving said holdback member to said unlatch position;

a deadbolt driver comprising a tension spring and having a first end coupled to said frame and a second end coupled to said deadbolt at a proximal end thereof, for sliding said deadbolt to said extended position when said holdback lever is in said unlatch position, and said slot in said frame extending parallel to the sliding directions of movement of said deadbolt, and said deadbolt further comprises a pin protecting into said slot perpendicular to said frame side and to said sliding directions for maintaining linear sliding movement of said deadbolt in said sliding directions; and a retraction assembly comprising a retraction arm having a pivot end pivotally mounted on said frame and a free end having an opening therein and said pin of said deadbolt extending through said opening to define an operative connection of said deadbolt to said retraction arm for moving said deadbolt from said extended position to said retracted position, said retraction assembly further comprising a coupler coupling rotational motion of said door handle in either rotational direction to said retraction arm, whereby rotation of said door knob or handle in either direction pivots said retraction arm in a direction to move said deadbolt from said extended position to said retracted position.

2. The door lock arrangement as claimed in claim 1, wherein:

said deadbolt has a ledge formed adjacent said proximal end thereof;

said free end of said retraction arm has a nose portion;

said opening in said retraction arm is larger than said pin, whereby said pin has limited movement within said opening and said retraction arm has limited pivoting motion forwardly, in a direction toward said extended position of said deadbolt, and rearwardly, in a direction toward said retracted position of said deadbolt; and said retraction arm nose portion lies in the path of said deadbolt ledge when said deadbolt is in said extended position to block movement of said deadbolt toward said retracted position.

3. The door lock arrangement as claimed in claim 2, wherein:

said deadbolt has a lateral latch edge and at least one lateral groove formed intermediate its proximal and distal ends; and said holdback lever is latchably engageable with any one of said latch edge and at least one lateral groove, whereby said deadbolt is latchable at said retracted position and at least one other position intermediate said retracted position and said extended position.

4. The door lock arrangement as claimed in claim 3, wherein:

rotation of said door knob or handle in either direction retracts said deadbolt to selected ones of said latch positions including said retracted position; and said retraction arm pivots said nose portion out of the path of said deadbolt ledge at all deadbolt latch positions except said extended position of said deadbolt.

5. The door lock arrangement as claimed in claim 2, wherein:

said free end of said retraction arm follows movement of said deadbolt by virtue of said deadbolt pin being captured in said retraction arm opening;

the center of gravity of said pivotable retraction arm is forward of pivot axis; and said nose portion of said retraction arm is moved into the path of said deadbolt ledge as a result of forward momentum as said deadbolt moves to said extended position, and as a result of gravity acting on said retraction arm.

6. The door lock arrangement as claimed in claim 1, wherein said retraction assembly comprises:

a hub rotatably mounted to said frame and rotatable, in either rotational direction, by said door knob or handle, said hub having a pair of radially extending lobes;

a biased coupling pivotally connected to said frame and having a pair of camming surfaces engageable by respective camming surfaces of said hub lobes, said biased coupling biasing said hub to a balanced position at which both camming surfaces of said biased coupling engage respective camming surfaces of said hub lobes; and said biased coupling comprises a projection engageable with an intermediate edge of said retraction arm, whereby rotation of said door knob or handle effects corresponding rotation of said hub which effects corresponding camming of said biased coupling which forces said retraction arm to pivot and retract said deadbolt.

7. The door lock arrangement as claimed in claim 6, wherein:

upon release of said door handle, said biased coupling returns said hub to said balanced position, and said biased coupling projection moves away from said retraction arm.

8. A door lock arrangement comprising:

a frame having an elongated slot formed in a side thereof;

a door handle;

a deadbolt slidable in sliding directions in said frame between a retracted position and an extended position said deadbolt having a distal end extendable out of said frame in said extended position, and a proximal end maintained within said frame, said deadbolt further having a ledge formed adjacent said proximal end thereof and said dead bolt having a pin extending therefrom and said slot in said frame extends parallel to said sliding directions of movement of said dead bolt, and said deadbolt further comprising a pin extending therefrom into said slot in said frame perpendicularly to said frame side and perpendicularly to said sliding directions for maintaining linear sliding movement of said deadbolt in said sliding directions;

a holdback lever latchable with said deadbolt and movably mounted on said frame for movement between a latch position at which said deadbolt is prevented from moving to said extended position from said retracted position, and an unlatch position at which said deadbolt is free to move to said extended position from said retracted position and said holdback lever is resiliently biased toward said latch position;

a depressable trigger member projecting through a side of said frame, said trigger member, when depressed, engaging said holdback lever and moving said holdback member to said unlatch position;

a deadbolt driver comprising a tension spring having a first end connected to said frame and a second end, coupled to said deadbolt at said proximal end thereof, for sliding said deadbolt to said extended position when said holdback lever is in said unlatch position; and a retraction assembly comprising a retraction arm pivotally mounted on said frame and operatively connected to said deadbolt for moving said deadbolt from said extended position to said retracted position, said retraction arm comprising a contact position lying in the path of said deadbolt ledge when said deadbolt is in said extended position to block movement of said deadbolt toward said retracted position.

9. The door lock arrangement as claimed in claim 8, wherein:

said retraction arm has a pivot end and a free end;

said pivot end is pivotally mounted to said frame; and said free end has an opening therein through which said pin passes, thereby defining said operative connection of said retraction arm to said deadbolt.

10. The door lock arrangement as claimed in claim 9, wherein:

said free end of said retraction arm has a nose portion defining said contact portion; and said opening in said retraction arm is larger than said pin, whereby said pin has limited movement within said opening and said retraction arm has limited pivoting motion forwardly, in a direction toward said extended position of said deadbolt, and rearwardly, in a direction toward said retracted position of said deadbolt.

11. The door lock arrangement as claimed in claim 10, wherein:

when said deadbolt has a lateral latch edge and at least one lateral groove formed intermediate its proximal and distal ends; and said holdback lever is latchably engageable with any one of said latch edge and at least one lateral groove, whereby said deadbolt is latchable at said retracted position and at least one other position intermediate said retracted position and said extended position.

12. The door lock arrangement as claimed in claim 11, wherein:

rotation of said door knob or handle in either direction retracts said deadbolt to selected ones of said latch positions including said retracted position; and said retraction arm pivots said nose portion out of the path of said deadbolt ledge at all deadbolt latch positions except said extended position of said deadbolt.

13. The door lock arrangement as claimed in claim 10, wherein:

said free end of said retraction arm follows movement of said deadbolt by virtue of said deadbolt pin being captured in said retraction arm opening;

the center of gravity of said pivotable retraction arm is forward of pivot axis; and said nose portion of said retraction arm is moved into the path of said deadbolt ledge as a result of forward momentum as said deadbolt moves to said extended position, and as a result of gravity acting on said retraction arm.

14. The door lock arrangement as claimed in claim 8, wherein said retraction assembly comprises:

a hub rotatably mounted to said frame and rotatable, in either rotational direction, by said door knob or handle, said hub having a pair of radially extending lobes;

a biased coupling pivotally connected to said frame and having a pair of camming surfaces engageable by respective camming surfaces of said hub lobes, said biased coupling biasing said hub to a balanced position at which both camming surfaces of said biased coupling engage respective camming surfaces of said hub lobes; and said biased coupling comprises a projection engageable with an intermediate edge of said retraction arm, whereby rotation of said door knob or handle effects corresponding rotation of said hub which effects corresponding camming of said biased coupling which forces said retraction arm to pivot and retract said deadbolt.

15. The door lock arrangement as claimed in claim 14, wherein:

upon release of said door knob or handle, said biased coupling returns said hub to said balanced position, and said biased coupling projection moves away from said retraction arm.

* * * * *

UNITED STATES PATENT AND TRADEMARK OFFICE

CERTIFICATE OF CORRECTION

PATENT NO. : 5,941,581

DATED : August 24, 1999

INVENTOR(S) : Michael E. Heithe

It is certified that error appears in the above-identified patent and that said Letters Patent is hereby corrected as shown below:

Column 8, line 5, delete "deadbolt further comprising a".

Column 8, line 6, delete "therefrom".

Signed and Sealed this

Nineteenth Day of December, 2000

*Attest:*

Q. TODD DICKINSON

*Attesting Officer*

*Commissioner of Patents and Trademarks*